US008029337B2

(12) United States Patent
Larson et al.

(10) Patent No.: US 8,029,337 B2
(45) Date of Patent: Oct. 4, 2011

(54) METHODS AND SYSTEMS FOR MARRING FIBER OPTIC SUBSTRATES

(75) Inventors: David B. Larson, Huntington Beach, CA (US); Brian M. Spahnie, Brunswick, OH (US)

(73) Assignee: Lumitex, Inc., Strongsville, OH (US)

( * ) Notice: Subject to any disclaimer, the term of this patent is extended or adjusted under 35 U.S.C. 154(b) by 0 days.

(21) Appl. No.: 12/907,064

(22) Filed: Oct. 19, 2010

(65) Prior Publication Data

US 2011/0034110 A1 Feb. 10, 2011

Related U.S. Application Data

(62) Division of application No. 11/327,968, filed on Jan. 9, 2006, now Pat. No. 7,833,087.

(51) Int. Cl.
*B24B 5/38* (2006.01)

(52) U.S. Cl. ..... 451/41; 451/163

(58) Field of Classification Search ..... 451/57, 451/58, 41, 163
See application file for complete search history.

(56) References Cited

U.S. PATENT DOCUMENTS 4,929,169 A * 5/1990 Fujigaki et al. ..... 425/385
5,312,569 A * 5/1994 Mezei ..... 264/1.24

* cited by examiner

*Primary Examiner* — Robert Rose
(74) *Attorney, Agent, or Firm* — Renner, Otto, Boisselle & Sklar, LLP

(57) ABSTRACT

Methods and systems for marring fiber optic substrates may include rollers with abrasive surfaces that press lengths of the substrates against elongated supports, which may be tapered, during relative lengthwise movement between the rollers and supports; abrasive sheets that are vibrated against the substrates; abrasive flap wheels that are rotated to cause flexible abrasive flaps on the wheels to strike the substrates; rotating blades that cut a transverse marring pattern in the substrates; hammers having abrasive surfaces that are oscillated to strike the substrates; and water jet abrasive slurries that are directed at the substrates.

8 Claims, 3 Drawing Sheets

METHODS AND SYSTEMS FOR MARRING FIBER OPTIC SUBSTRATES

CROSS-REFERENCE TO RELATED APPLICATIONS

This application is a division of U.S. patent application Ser. No. 11/327,968, filed Jan. 9, 2006, the entire disclosure of which is incorporated herein by reference.

FIELD OF THE INVENTION

This invention relates to different methods and systems for marring fiber optic substrates to create fiber optic illuminators.

BACKGROUND OF THE INVENTION

Fiber optic substrates can be made into illuminators by marring or abrading (hereinafter collectively referred to as "marring") the surface of the optical fibers at various points along their length to cause a portion of the light entering one or both ends of the optical fibers to be emitted from the marred surface areas. Such illuminators may be used for example for display lighting, background lighting, front lighting and/or ornamental lighting and the like.

Increased surface marring results in increased light emission. Accordingly, the intensity of the light emitted along the length of the substrates can be varied by varying the density or aggressiveness of the surface marring.

It is generally known to mar fiber optic substrates by stamping, machining, molding, sandblasting or rolling fiber optic substrates to create a desired marring pattern on a surface of the substrates. However, there is a continuing need for other effective methods and systems for marring fiber optic substrates to create fiber optic illuminators having a desired illumination pattern.

SUMMARY OF THE INVENTION

This invention relates to different methods and systems for marring fiber optic substrates to create relatively inexpensive illuminators having a desired illumination pattern.

In accordance with one aspect of the invention, the system includes at least one roller for pressing a length of fiber optic substrate against a tapered surface on an elongate support while causing relative movement between the roller and support lengthwise of the support with the roller rolling along the substrate. At least one of the roller and the support supports or has an abrasive or textured surface thereon (hereinafter collectively referred to as "abrasive") to produce a progressively more aggressive marring pattern along the length of the substrate during such relative lengthwise movement between the roller and support.

In accordance with another aspect of the invention, the system includes an abrasive sheet that is vibrated against a length of fiber optic substrate to produce a marring pattern on the substrate.

In accordance with another aspect of the invention, the system includes a series of rotating blades that cut a crosswise marring pattern in a length of fiber optic substrate during crosswise movement of the substrate relative to the rotating blades.

In accordance with another aspect of the invention, the system includes a plurality of rollers having surfaces with different types, sizes or amounts of abrasive thereon that produce different marring patterns on a length of fiber optic substrate on an elongate support during relative movement between the rollers and the support lengthwise of the support depending on which rollers selectively press the substrate against the support during such relative lengthwise movement.

In accordance with another aspect of the invention, the system includes an oscillating hammer having an abrasive surface thereon that strikes a length of fiber optic substrate on an elongate support to produce a marring pattern on the substrate.

In accordance with another aspect of the invention, the system includes a nozzle that directs a water jet abrasive slurry at a length of fiber optic substrate on an elongate support during movement of the support lengthwise relative to the water jet abrasive slurry to produce a marring pattern on the substrate.

In accordance with another aspect of the invention, the system includes at least one wheel which when rotated, causes circumferentially spaced abrasive flaps on the wheel to move radially outward due to centrifugal force and strike a length of fiber optic substrate on an elongate support during relative movement between the wheel and the support lengthwise of the support to produce a marring pattern on the substrate.

These and other objects, advantages, features and aspects of the invention will become apparent as the following description proceeds.

To the accomplishment of the foregoing and related ends, the invention, then, comprises the features hereinafter more fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

Figure 1:
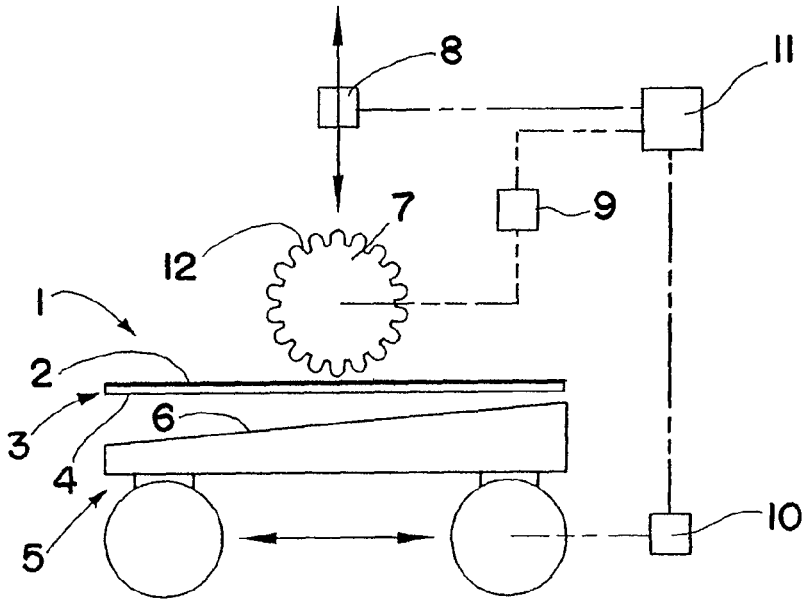
FIG. 1 is a schematic illustration of one system embodiment of the invention including at least one roller having an abrasive surface thereon that is movable toward and away from a tapered surface on an elongate support for pressing a length of fiber optic substrate against the tapered surface during lengthwise movement of the support relative to the roller to produce a progressively more aggressive marring pattern along the length of the substrate.

Referring now in detail to the drawings, wherein the same reference numerals are used to designate like parts, and initially to FIG. 1, there is schematically shown a system 1 in accordance with the invention for marring the surface of optical fibers 2 of a fiber optic substrate 3 for causing light applied to one or both ends of the optical fibers to be emitted from the marred surface areas thereof. The substrate 3 may be comprised of a plurality of such optical fibers 2 adhered to a suitable backing 4 which may, for example, be a plastic reflective sheet. The surfaces of other light guides including fiber optic rods and transparent films, sheets or plates may also be marred in accordance with the invention to create illuminators having a desired illumination pattern.

System 1 includes an elongate support 5 having a generally flat, tapered support surface 6 for supporting a length of fiber optic substrate 3 thereon. One or more rollers 7 may be supported for example by an actuator 8 or other suitable mechanism for movement toward and away from the support for releasably pressing the substrate against the tapered surface 6 during relative lengthwise movement between the support and roller to mar a surface of the substrate.

In the embodiment shown in FIG. 1, roller 7 is movable toward and away from support 5 and support 5 is movable lengthwise relative to roller 7. However, it will be appreciated that the support may be fixed and the roller may be mounted for lengthwise movement relative to the support as well as for movement toward and away from the support or vice versa. Roller 7 may be rotated by any suitable drive motor 9 to cause the roller to roll along the substrate at the same rate of relative lengthwise movement between the roller and support so there is no relative rotational movement between the roller and support during marring of the substrate. To that end, the drive motor 9 for rotating the roller and the drive mechanism 10 for causing lengthwise movement of the support relative to the roller may all commonly be controlled by a programmable controller 11 or the like. Similar type drive mechanisms and controls may also be included in the systems shown in the various other drawing figures.

The outer surface of roller 7 may be roughened or serrated or covered with different amounts and sizes of a diamond coating or grit sandpaper or other suitable abrasive material to provide an abrasive surface 12 thereon for marring the substrate during relative lengthwise movement between the roller and support with the roller pressing the substrate against the support as the roller rolls along the support. Alternatively, the abrasive surface may be on the tapered support surface 6 or on an abrasive sheet that may be interposed between the substrate and the support or between the roller and the substrate to mar the substrate during such relative lengthwise movement. If the abrasive surface is on the tapered support surface or an abrasive sheet is interposed between the substrate and the support, the substrate would have to be flipped over to expose the optical fibers to the abrasive surface.

Because the support surface 6 is tapered, the substrate 3 will be progressively marred more aggressively in the direction of increasing taper. This has the advantage that the light output from the substrate will be more uniform if the substrate is marred less aggressively near where the light enters the substrate (e.g., at the left end of the substrate shown in FIG. 1) and more aggressively further away from where the light enters the substrate. The amount of taper of the support surface may be varied depending on the thickness and length of the optical fiber substrate and the type of abrasive used to mar the substrate. However, the taper will be relatively small, for example, generally greater than 0 degrees and less than 3 degrees as measured from the horizontal, but is shown substantially larger than that in FIG. 1 for illustrative purposes.

If desired, the pressure between the roller 7 and the support surface 6 may be varied during such relative lengthwise movement between the roller and support to vary the marring pattern. Also, the roller and support may be moved back and forth lengthwise relative to one another with the roller pressing the substrate against the support surface during relative lengthwise movement in the direction of increasing taper as many times as desired to produce a more or less aggressive marring pattern on the substrate.

Figure 2:
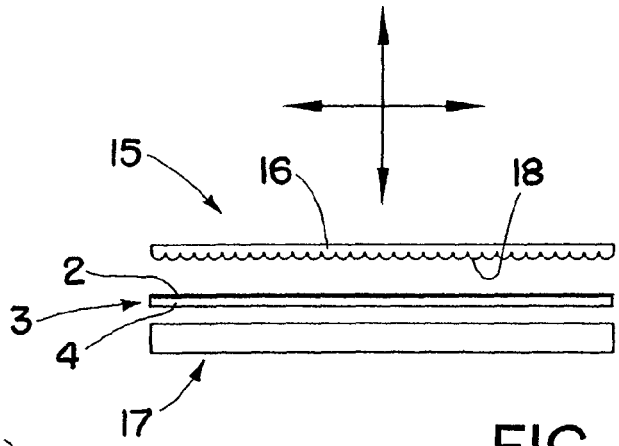
FIG. 2 is a schematic illustration of another system embodiment of the invention including an abrasive sheet that is vibrated against a length of fiber optic substrate to produce a marring pattern on the substrate.

FIG. 2 schematically shows another system 15 in accordance with the invention which includes an abrasive sheet 16 that is vibrated while in contact with a length of fiber optic substrate 3 held stationary on an elongate support 17 to produce a marring pattern on the length of fiber optic substrate contacted thereby. The extent of marring of the substrate will depend on such factors as the type, size or amount of abrasive used, how aggressively the abrasive sheet is vibrated and the length of the vibration cycle. Further, the abrasive surface 18 on the sheet 16 may have a variable pattern to produce a variable marring pattern on the substrate. If the surface area of the abrasive sheet is smaller than the surface area of the substrate, one or the other of the abrasive sheet and the elongate support may be indexed relative to one another to abrade different surface areas of the substrate if desired.

Figure 3:
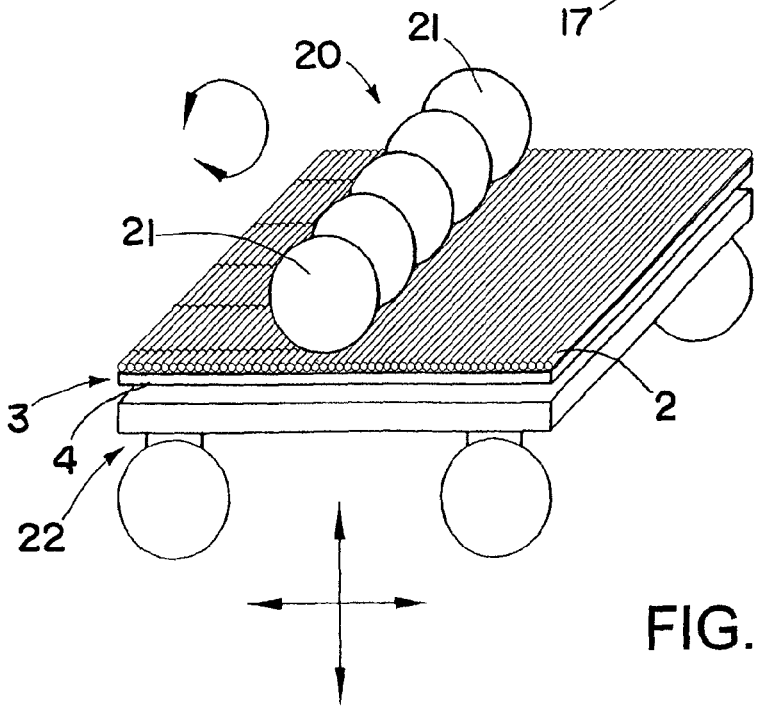
FIG. 3 is a schematic illustration of another system embodiment of the invention including a series of blades which when rotated produce a crosswise marring pattern on a length of fiber optic substrate during crosswise movement of the substrate relative to the rotating blades.

FIG. 3 schematically shows another system 20 in accordance with the invention which includes a series of laterally spaced rotating blades 21 that cut a crosswise marring pattern on a length of fiber optic substrate 3 supported on an elongate support 22 during crosswise movement of the support relative to the blades. The depth of the marring pattern may be varied by raising or lowering the elongate support relative to the blades. Also the blades 21 may be set at different heights and/or may be of different diameters or widths and may have different spacings therebetween to cut a variable marring pattern in the substrate.

Figure 4:
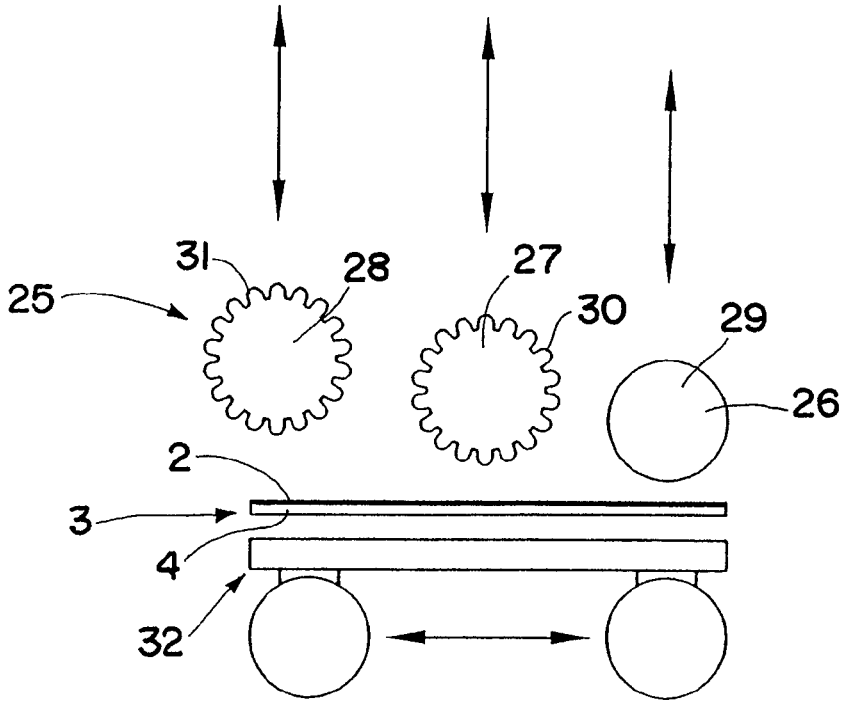
FIG. 4 is a schematic illustration of another system embodiment of the invention including a plurality of rollers having surfaces thereon of different types, sizes or amounts of abrasive that produce different marring patterns on a length of fiber optic substrate on an elongate support during lengthwise movement of the support relative to the rollers depending on which rollers selectively press the fiber optic substrate against the support during such relative lengthwise movement.

FIG. 4 schematically shows another system 25 in accordance with the invention including a plurality of rollers 26, 27, 28 having abrasive surfaces 29, 30 and 31 with different types, sizes or amounts of abrasive thereon that produce different marring patterns on a length of fiber optic substrate 3 on an elongate support 32 during relative movement between the rollers and support lengthwise of the support depending on which rollers are pressed against the fiber optic substrate during such relative lengthwise movement. For example, one of the rollers 26 may have a relatively fine abrasive surface 29, another roller 27 may have a medium abrasive surface 30, still another roller 29 may have a more aggressive abrasive surface 31, and so on. The marring pattern may be varied along the length of the substrate 3 depending on which roller or rollers are pressed against the substrate at different times during such relative lengthwise movement between the support and the rollers. Also the pressure of one or more of the rollers against the substrate may be varied during such relative lengthwise movement between the rollers and support to produce a desired marring pattern.

Figure 5:
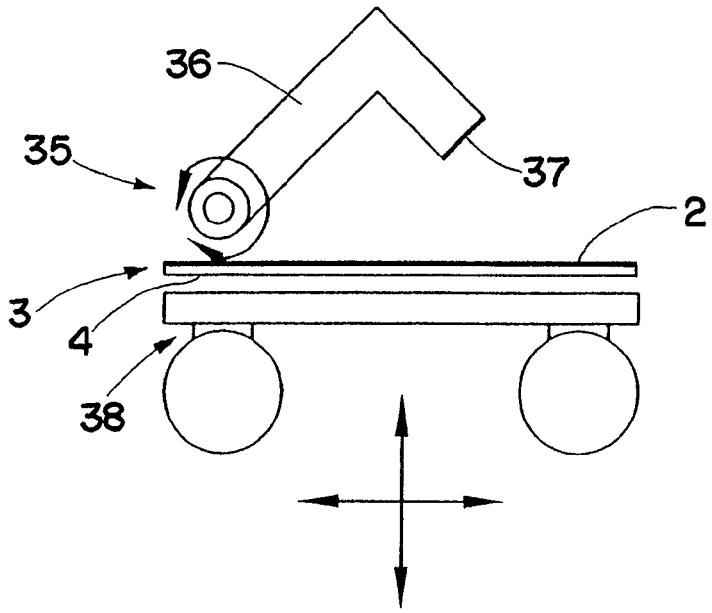
FIG. 5 is a schematic illustration of another system embodiment of the invention including an oscillating hammer having an abrasive surface thereon that is caused to strike a length of fiber optic substrate on an elongate support between lengthwise indexing movements of the support relative to the hammer to produce a marring pattern on the substrate.

FIG. 5 schematically shows another system 35 in accordance with the invention including a pivotally mounted hammer 36 having an abrasive surface 37 thereon which may be oscillated to cause the abrasive surface to strike those areas of a length of fiber optic substrate 3 supported by an elongate support 38 where marring is desired. Support 38 may be indexed relative to the hammer lengthwise of the support between impacts by the hammer to produce a desired marring pattern on the substrate. Also the number of times that the hammer strikes a particular surface area of the substrate and the force applied by the hammer against a particular surface area of the substrate may be varied to vary how aggressively the different areas of the substrate are marred to produce a desired illumination pattern.

Figure 6:
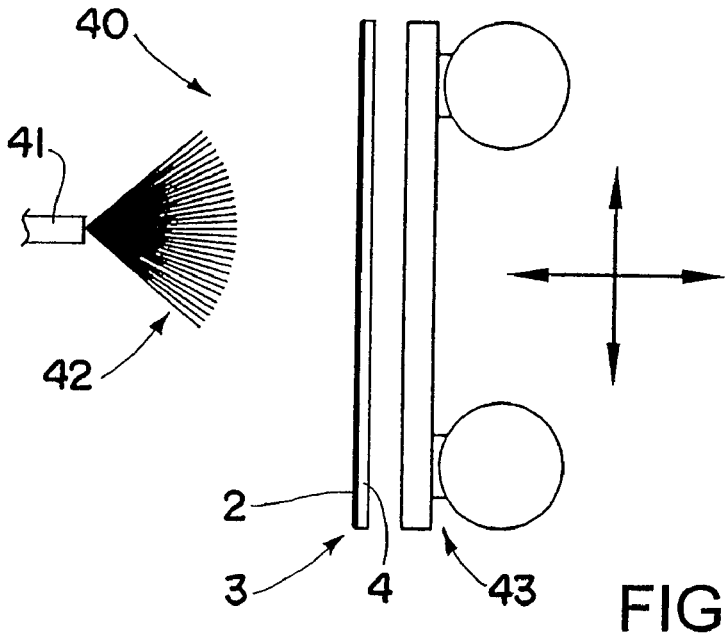
FIG. 6 is a schematic illustration of another system embodiment of the invention including a nozzle that directs a water jet abrasive slurry against a length of fiber optic substrate on an elongate support during lengthwise movement of the support relative to the water jet abrasive slurry to produce a marring pattern on the substrate.

FIG. 6 schematically shows another system 40 in accordance with the invention including one or more nozzles 41 for directing a water jet abrasive slurry 42 containing a suitable abrasive against a length of fiber optic substrate 3 on an elongate support 43 during relative movement between the nozzle and support lengthwise of the support to produce a desired marring pattern on the substrate. Using water as the carrier for the abrasive material has the advantage of producing very little dust. Also the water helps carry the abrasive material away from the substrate for easy runoff, especially if during the marring operation, the elongate support moves the substrate vertically relative to the nozzle and the nozzle directs the slurry horizontally at the substrate as schematically shown in FIG. 6.

In order to produce a variable marring pattern, the water jet abrasive slurry nozzle 41 may be intermittently operated by a suitable controller as the elongate support 43 moves lengthwise relative to the nozzle at a constant speed. Alternatively, the elongate support may be caused to move lengthwise relative to the water jet abrasive slurry nozzle at a variable speed in order to produce a desired illumination pattern.

Figure 7:
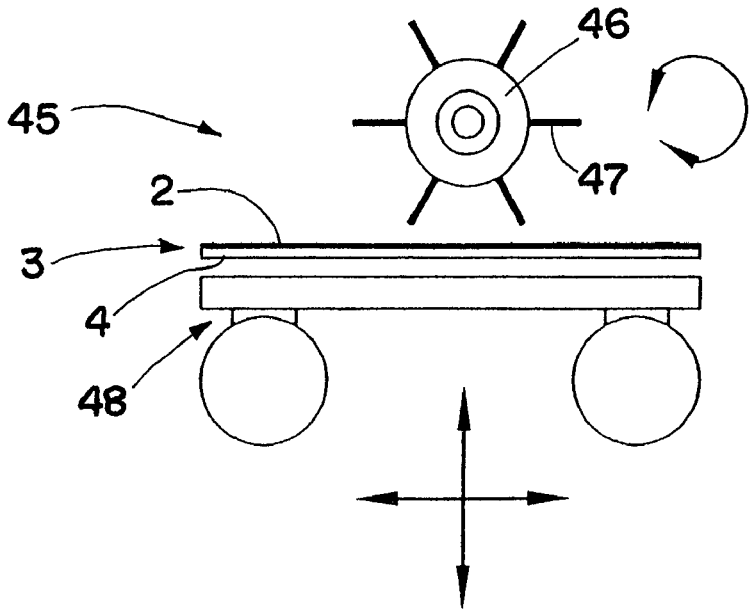
FIG. 7 is a schematic illustration of another system embodiment of the invention including at least one wheel having circumferentially spaced flexible abrasive flaps thereon which, during rotation of the wheel, are caused to extend radially outward due to centrifugal force and strike a length of fiber optic substrate on an elongate support during lengthwise movement of the support relative to the wheel to produce a marring pattern on the substrate.

FIG. 7 schematically shows another system 45 in accordance with the invention including at least one wheel 46 having a plurality of circumferentially spaced flexible abrasive flaps 47. When the wheel is rotated, the centrifugal force will cause the flaps to extend radially outward as shown in FIG. 7 and strike a length of fiber optic substrate 3 on an elongate support 48 during relative movement between the wheel and support lengthwise of the support to produce a marring pattern on the substrate. These flexible abrasive flaps 47 may, for example, be flexible wires or sandpaper strips or the like. The extent of marring of the substrate by the flaps may be varied by varying the rotational speed of the wheel or relative movement between the wheel and support lengthwise of the support or height of the support relative to the wheel in order to produce a desired marring pattern on the substrate.

Although the invention has been shown and described with respect to certain embodiments, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein illustrated exemplary embodiments of the invention. Also, all of the disclosed functions may be computerized and automated as desired. In addition, while a particular feature of the invention may have been disclosed with respect to only one embodiment, such feature may be combined with one or more other features as may be desired and advantageous for any given or particular application.

What is claimed is:

1. A method of marring a fiber optic substrate comprising the steps of supporting a length of the substrate on an elongate support, oscillating a hammer to cause an abrasive surface on the hammer to strike an area of the substrate to mar such area, and indexing the support relative to the hammer between hammer strikes to present different areas of the substrate to the hammer for marring by the hammer.

2. The method of claim 1 wherein the indexing movements of the substrate relative to the hammer are varied to provide a desired marring pattern on the substrate.

3. The method of claim 1 wherein the force applied by the hammer against different areas of the substrate is varied to provide a variable marring pattern on the substrate.

4. A method of marring a fiber optic substrate comprising the steps of supporting the substrate on an elongate support and applying a striking force to an area of the substrate to mar such area, wherein an oscillating hammer is used to apply the striking force to the substrate.

5. The method of claim 4 wherein the substrate is indexed between strikes to provide a desired marring pattern on the substrate.

6. The method of claim 5 wherein the indexing of the substrate is varied between strikes to provide a desired marring pattern on the substrate.

7. The method of claim 5 wherein a variable striking force is applied to the substrate to provide a variable marring pattern on the substrate.

8. The method of claim 4 wherein the oscillating hammer has an abrasive surface that strikes an area of the substrate to mar such area.

* * * * *